United States Patent [19]

Nagano

[11] Patent Number: 4,662,340

[45] Date of Patent: May 5, 1987

[54] ELECTRONIC FUEL INJECTION SYSTEM FOR INTERNAL COMBUSTION ENGINE

[75] Inventor: Masami Nagano, Katsuta, Japan

[73] Assignee: Hitachi, Ltd., Tokyo, Japan

[21] Appl. No.: 847,306

[22] Filed: Apr. 2, 1986

[30] Foreign Application Priority Data

Apr. 2, 1985 [JP] Japan ..... 60-69414

[51] Int. Cl.[4] ..... F02M 51/00; F02D 9/06

[52] U.S. Cl. ..... 123/492; 123/326

[58] Field of Search ..... 123/492, 326, 480, 486, 123/493; 364/431.07

[56] References Cited

U.S. PATENT DOCUMENTS

| | | | |
|---|---|---|---|
| 4,513,723 | 4/1985 | Ishikawa et al. | 123/492 |
| 4,528,964 | 7/1985 | Kashiwaya et al. | 123/492 |
| 4,561,404 | 12/1985 | Kanno et al. | 123/492 |
| 4,590,564 | 5/1986 | Ishikawa et al. | 123/492 |
| 4,590,912 | 5/1986 | Atago | 123/492 |

*Primary Examiner*—Raymond A. Nelli

*Attorney, Agent, or Firm*—Antonelli, Terry & Wands

[57] ABSTRACT

A fuel injection apparatus in an internal combustion engine, which comprises a fuel injection valve device for supplying the engine with fuel, an air flow rate detector for detecting a quantity of air sucked by the engine, a detector for detecting a revolutional speed of the engine, apparatus for determining whether the engine is in a highly loaded state or not, and a control arrangement for calculating a basic pulse width of a valve opening pulse for the injection valve device on the basis of respective output signals of the respective detectors. The control arrangement is arranged to add a first valve-opening pulse width correction value to the calculated fundamental pulse width on the basis of a correction map predetermined corresponding to various values of the revolutional speed of the engine to thereby obtain a corrected pulse width, and to further add a second valve-opening pulse width correction value to the corrected pulse width on the basis of a predetermined high-load correction map when the engine is in a highly loaded state, thereby making small the variation in air fuel ratio in performing the power correction in the engine.

5 Claims, 10 Drawing Figures

| | | | | | | | | |
|---|---|---|---|---|---|---|---|---|
| $T_{Pn}$ | | | | | | | | $K_{AF\,nm}$ |
| | | | | | | | | |
| $T_{Pi}$ | | | | | | $K_{AF\,ii}$ | | |
| | | | | | | | | |
| $T_{P5}$ | | | | $K_{AF\,55}$ | | | | |
| | | | | | | | | |
| $T_{P2}$ | | $K_{AF\,22}$ | | | | | | |
| $T_{P1}$ | $K_{AF\,11}$ | | | | | | | |
| | $N_1$ | $N_2$ | | $N_5$ | | $N_i$ | | $N_m$ |

ELECTRONIC FUEL INJECTION SYSTEM FOR INTERNAL COMBUSTION ENGINE

BACKGROUND OF THE INVENTION

The present invention relates to an electronic fuel injection system for an internal combustion engine, provided with power correction means for increasing a quantity of fuel injection when the engine is in a highly loaded state.

Referring to FIGS. 1 and 2, description will be made as to a typical example of a system for increasing a quantity of fuel injection when an internal combustion engine mounted on a car or the like comes into a highly loaded state, that is, a so-called power correction system, in the conventional electronic fuel injection apparatus in the internal combustion engine. First, a basic pulse width $T_p$ of a valve opening pulse for opening a fuel injection valve is calculated through the following expression (1) on the basis of a revolutional speed N (r.p.m.) of the engine and a quantity $Q_a$ of an air flow sucked into the engine.

$$T_p = K(Q_a/N) \quad (1)$$

(K: a constant)

Next, a correction factor $K_{AF}'$ for a ratio of air-fuel mixture (hereinafter simply referred to as "air-fuel ratio") corresponding to the revolutional speed N of the engine, and the calculated basic pulse width $T_p$ is retrieved from a map, the correction factor $K_{AF}'$ being used for compensating the characteristics of the injection valve, an air flow meter, or the like. A valve opening pulse width (that is, a period of fuel injection) $T_i$ actually applied to the fuel injection valve is obtained on the basis of the basic pulse width $T_p$ and the thus obtained correction factor $K_{AF}'$ through the following expression (2).

$$T_i = T_p(1 + K_{AF}') \quad (2)$$

Assume now that the revolutional speed N of the engine is kept constant. The basic pulse width $T_p$ is increased in response to the increase in engine load before a predetermined value $T_{p4}$ is reached, with the correction factor $K_{AF}'$ kept zero. Thereafter, the value of the correction factor $K_{AF}'$ is increased stepwise to decrease the air-fuel ratio to thereby gradually make the air-fuel mixture rich. That is, the value of the correction factor $K_{AF}'$ is gradually increased in a transition region $T_{p4}$–$T_{p5}$ before the basic pulse width $T_p$ reaches a threshold value $T_{p5}$ of a highly loaded region, that is, a power correction region. Thereafter, that is when the basic pulse width $T_p$ comes into the power correction region, the correction factor $K_{AF}'$ is kept at a substantially constant value. Thus, conventionally, when the basic pulse width $T_p$ comes into the power correction region, the injection pulse width is increased with a large correction factor $K_{AF}'$ to increase the engine output.

However, the pulsation of suction air in a cylinder of an engine becomes apt to be transmitted to an air flow sensor disposed in the upstream of a throttle valve in a suction pass as the opening degree of the throttle valve is made larger, that is, as the basic pulse width $T_p$ is increased, and therefore the output signal of the air flow sensor representing the quantity of air flow $Q_a$ becomes apt to change or pulsate. As the quantity of air flow $Q_a$ pulsates, the basic pulse width $T_p$ obtained through the expression (1) also pulsates so as to cause the correction factor $K_{AF}'$ to fluctuate. This fluctuation in correction factor $K_{AF}'$ is violent in the transition region $T_{p4}$–$T_{p5}$ where the correction factor $K_{AF}'$ is increased stepwise as the basic pulse width $T_p$ is increased. Consequently, as shown in FIG. 2, in the case where the basic pulse width $T_p$ takes a value in the transition region $T_{p4}$–$T_{p5}$, the change in correction factor $K_{AF}'$ is large and therefore the degree of variation of the air-fuel ratio may exceed its target control value 0.4 to thereby change the revolutional speed of the engine to deteriorate the operation property of the engine and comfortable ride.

Further, the rate of fuel consumption becomes bad in the transition region $T_{p4}$–$T_{p5}$ because the air-fuel ratio is made unnecessarily rich.

SUMMARY OF THE INVENTION

An object of the present invention is to provide a fuel injection apparatus in an internal combustion engine, in which it is possible to make a variation in air-fuel ratio small when power correction in the engine is performed by changing the air-fuel ratio in a highly loaded state of the engine.

In order to attain such an object as described above, the electronic fuel injection system for an internal combustion engine is featured in that a first valve-opening pulse width correction value based on a correction map predetermined corresponding to various values of the revolutional speed of the engine is added to a basic pulse width for a fuel injection valve for supplying fuel into the engine calculated by a control circuit to thereby obtain a corrected pulse width, and that a second valve-opening pulse width correction value for the fuel injection valve is added to the corrected pulse width on the basis of a predetermined high-load correction map when the engine is in a highly loaded state, thereby making small the variation in air fuel ratio in performing the power correction in the engine.

The above and other objects and features of the invention will appear more fully hereinafter from a consideration of the following description taken in connection with the accompanying drawings.

DESCRIPTION OF THE PREFERRED EMBODIMENT

Referring to FIGS. 3 through 10, a typical embodiment of the fuel injection apparatus in an internal combustion engine according to the present invention will be described hereunder.

Figure 1:
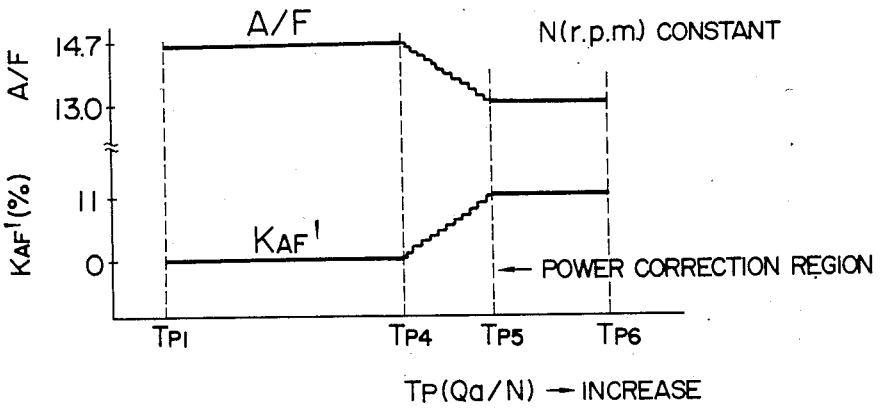
FIG. 1 PRIOR ART
FIG. 1 is a diagram for explaining a power correction system in the conventional fuel injection apparatus for an internal combustion engine.
Figure 2:
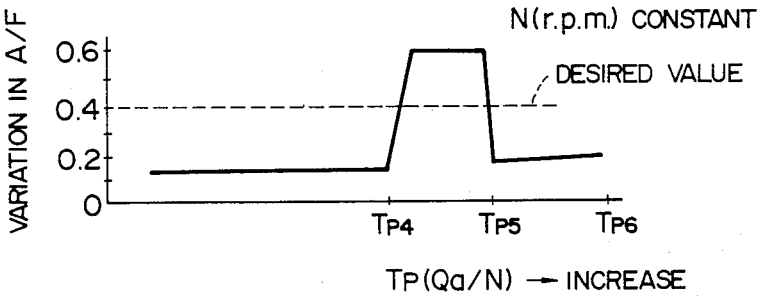
FIG. 2 PRIOR ART
FIG. 2 is a diagram showing variations in air-fuel ratio in the conventional power correction system shown in FIG. 1.
Figure 3:
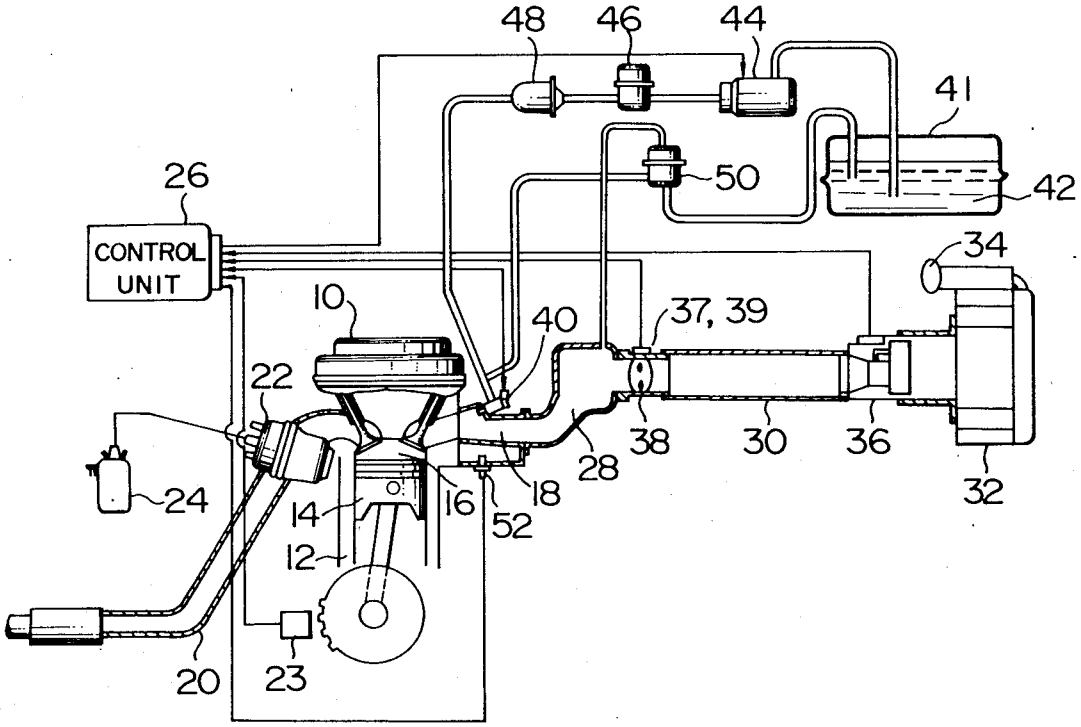
FIG. 3 is a diagram showing the arrangement of an embodiment of the fuel injection apparatus for an external combustion engine according to the present invention.

FIG. 3 is a diagram for explaining an arrangement of the fuel injection apparatus in a combustion engine according to the present invention. The internal combustion engine 10 is provided with a combustion chamber 16 in which a cylinder 12 and a piston 14 are provided, the combustion chamber 16 being communicated with a suction pipe 18 and an exhaust pipe 20. In the combustion chamber 16, there is further provided an ignition plug (not shown) for receiving a current from an ignition coil 24 through a distributor 22. A crank angular position sensor 23 is provided in the vicinity of a crank shaft for producing a pulse signal in synchronism with the revolution of the crank shaft. That is, the revolutional speed of the internal combustion engine 10 is detected by the crank angular position sensor 23 and applied to a control unit 26.

The suction pipe 18 is communicated with an air cleaner 32 through a collector 28 and a duct 30. Air sucked into the internal combustion engine 10 is caused to enter the air cleaner 32 from an inlet portion 34 thereof so as to be cleansed therein. The cleansed air is made to come into the duct 30 through a hot wire type air flow meter 36 and then entered into the combustion chamber 16 of the internal combustion engine 10 through a throttle valve 38, the collector 28, and the suction pipe 18. In the throttle valve 38, there are provided a throttle angle sensor 37 for detecting the opening degree of the throttle valve 38 and a throttle switch 39 for detecting the fully closed state of the same.

A fuel injection valve 40 mounted on the suction pipe 18 is controlled by the control unit 26 so as to supply fuel 42 from a fuel tank 41. That is, the fuel 42 in the fuel tank 41 is sucked by a fuel pump 44 energized by the control unit 26, filtered by a fuel filter 48 after pulsation in the fuel 42 has been absorbed by a fuel damper 46, and made to come into the fuel injection valve 40. Further, there is provided a fuel pressure regulator 50 between the fuel tank 41 and the fuel injection valve 40, and a negative pressure in the collector 28 is led into this fuel pressure regulator 50 so as to correct the fuel pressure in the collector 28 to thereby adjust the fuel injected by the fuel injection valve 40 to have a predetermined pressure value. Further, the reference numeral 52 designates a temperature detector for detecting a temperature of cooling water for the internal combustion engine 10.

Figure 4:
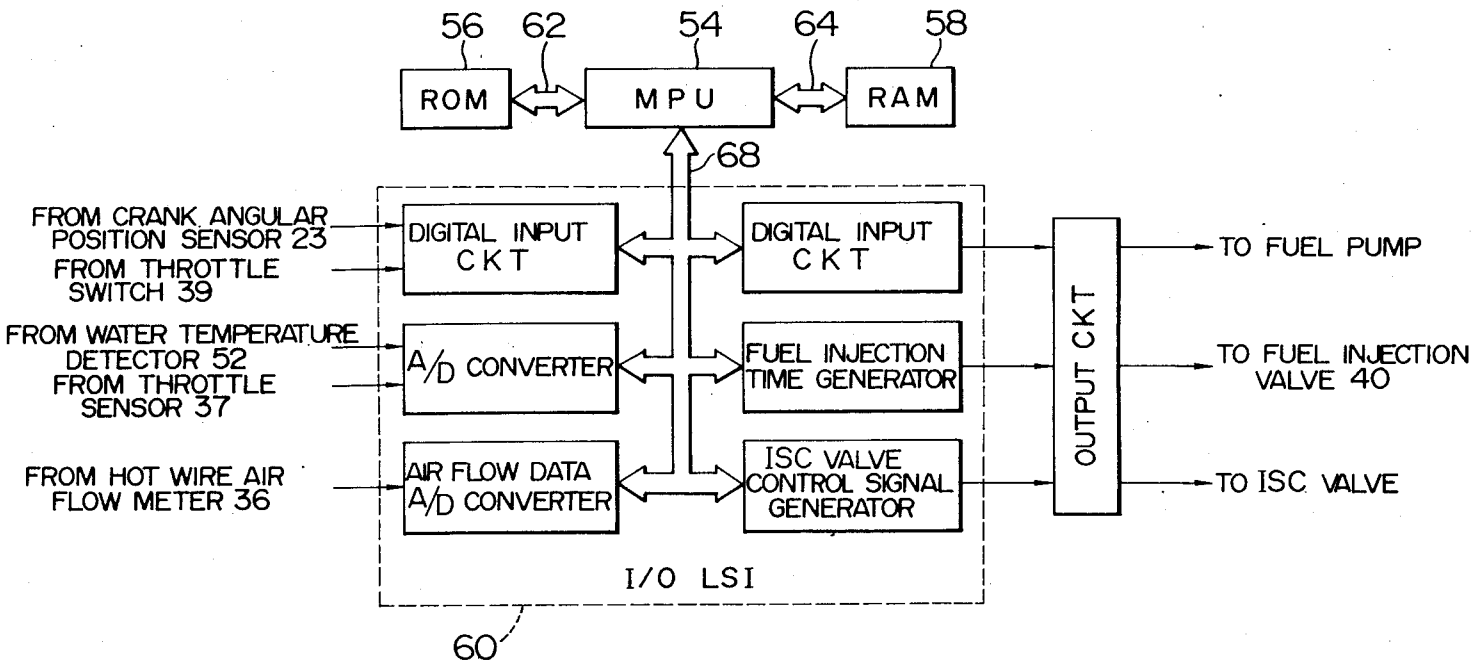
FIG. 4 is a block diagram showing the arrangement of the control unit of FIG. 3.

FIG. 4 shows the arrangement of the control unit 26, in which an MPU 54 provided with a judgement circuit (not shown) is connected to an ROM 56, for example, an EP-ROM, an RAM 58, and an input/output device 60, through busses 62, 64, and 68 respectively. Maps shown in FIGS. 5 to 7 and described later in detail are stored in the ROM 56. On the other hand, a revolutional speed signal from the crank angular position sensor 23, a water temperature signal from the water temperature detector 52, a throttle angle signal from the throttle angle sensor 37, an air flow quantity signal from the hot wire type air flow meter 36, and so on, are taken into the RAM 58 through the input/output device 16 to be temporarily stored therein. The MPU 54 calculates a valve opening period of time, that is, a fuel injection period of time $T_i$, of the fuel injection valve 40 on the basis of the data temporarily stored in the RAM 54 and the maps stored in the ROM 56 and sets the calculated data in a fuel injection time generating circuit so that a valve opening pulse having a pulse width corresponding to the calculated fuel injection period of time $T_i$ is supplied to the fuel injection valve 40 through an output circuit.

Although the fuel injection apparatus having such an arrangement as shown in FIGS. 3 and 4 is disclosed, for example, in Japanese Patent Unexamined Publication No. 57-70926 on May 1, 1982, the fuel injection apparatus according to the present invention is different from that disclosed in the foregoing prior art document in the function of the control unit 26 and in the data stored in the ROM 56.

The operation of the thus arranged embodiment will be described now.

As described above, after entered into the air cleaner 32 through the inlet portion 34 and cleansed in the air cleaner 32, the air is entered into the collector 28 through the duct 30 and the throttle valve 38 and then sucked into the combustion chamber 16 of the internal combustion engine 10 through the suction pipe 18. The fuel 42 in the fuel tank 41, on the other hand, is sucked by the fuel pump 44 and led into the fuel injection valve 40 through the fuel damper 46 and the fuel filter 48 so as to be injected into the air flowing in the suction pipe 18 to make an air-fuel mixture. The air-fuel mixture containing the fuel 42 in the combustion chamber 16 is burnt by a spark generated when the ignition plug (not shown) is supplied with a current from the ignition coil 24 through the distributor 22. The pulse width of the valve opening pulse, that is, the fuel injection period of time $T_i$, applied to the fuel injection valve 40 is calculated by the control unit 26 as follows.

$$T_i = T_p(1 + K_{AF} + K_p) \tag{3}$$

where $$T_p = Q_a/N \tag{4}$$

and where $T_p$ represents a basic pulse width of the valve opening pulse applied to the fuel injection valve 40; $Q_a$, a quantity of air flow; N, a revolutional speed (r.p.m.) of the internal combustion engine 10; $K_{AF}$, a correction factor of an air-fuel ratio obtained on the basis of the revolutional speed N and the basic pulse width $T_p$ from the map of FIG. 5 stored in the ROM 56; and $K_p$, a power correction factor, that is, a correction factor of the air-fuel ratio in a highly load state of the internal combustion engine 10 obtained on the basis of the revolutional speed N and the basic pulse width $T_p$ from the maps of FIGS. 6 and 7 stored in the ROM 56. That is, according to the present invention, the correction factor $K_{AF}$ is not used for performing the power correction but used only for compensating the characteristic of the injection valve 40, the air flow sensor 36, or the like. In the power correction in the internal combustion engine 10, on the other hand, the correction factor $K_p$ for performing the power correction is obtained separately from the correction factor $K_{AF}$ on the basis of the maps of FIGS. 6 and 7, and this correction factor $K_p$ is added to the correction factor $K_{AF}$.

Referring to a flowchart of FIG. 9, a routine of calculating the pulse width $T_i$ of the valve opening pulse applied to the fuel injection valve 40 in this embodiment will be described hereunder.

Figures 5, 6:
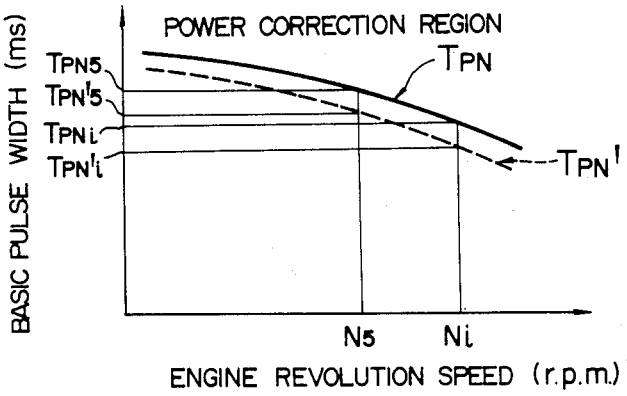
FIG. 5 is a diagram showing an example of the map of the air-fuel ratio correction factor stored in the ROM in the fuel injection apparatus according to the present invention.
FIG. 6 is a diagram for explaining an example of the map for detecting the power correction region on the basis of a revolutional speed of the engine and a basic pulse width.
Figure 7:
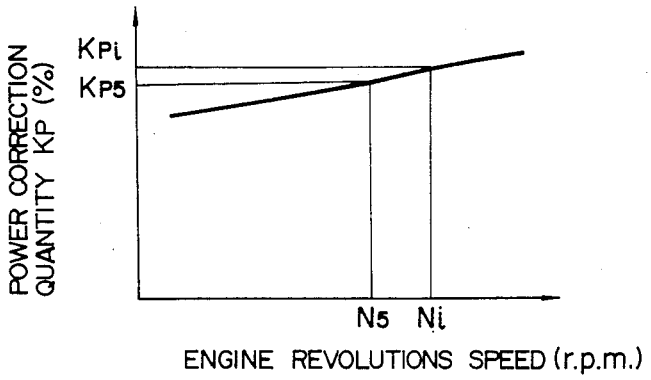
FIG. 7 is a diagram showing an example of the map of the relationship between the power correction factor and the revolutional speed of the engine.

Of the maps, the map of FIG. 5 stores various values of the correction factor $K_{AF}$ predetermined corresponding to various values off the revolutional speed $N_i$ and the basic pulse width $T_{pi}$, the map of FIG. 6 stores various values of a power correction initiation threshold $T_{PNi}$ as well as a power correction termination threshold $T_{PNi}$ of the basic pulse width $T_{pi}$ predetermined corresponding to various values of the revolutional speed $N_i$ of the engine, and the map of FIG. 7 stores various values of the power correction factor $K_{pi}$ predetermined corresponding to various values of the revolutional speed $N_i$ of the engine.

Figure 9:
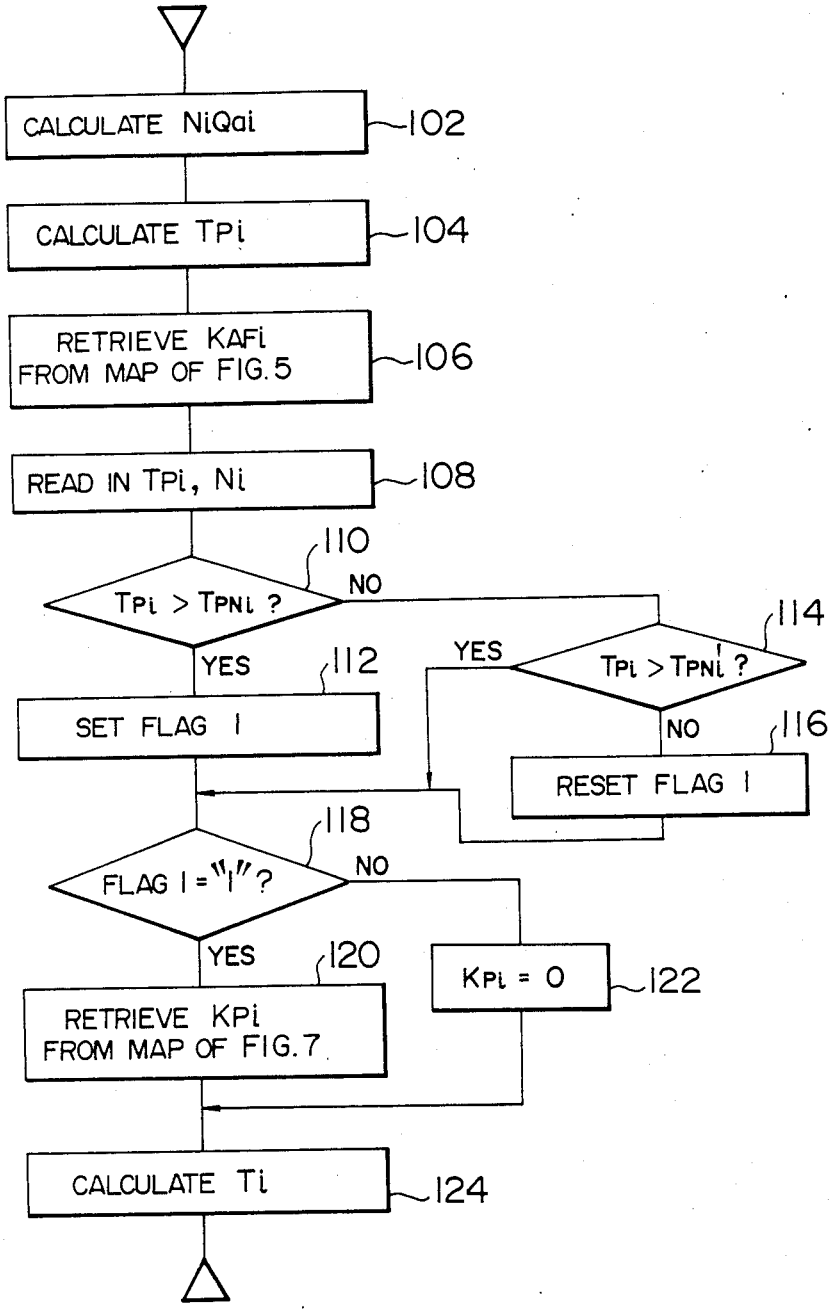
FIG. 9 is a flowchart for executing an example of the method of obtaining a pulse width of a valve opening pulse of the fuel injection valve according to the present invention.

The flowchart of FIG. 9 is executed by the MPU 54 on the basis of a program stored in the ROM 56.

First, in a step 102, a revolutional speed signal from the throttle angle sensor 37 is taken in so as to obtain the revolutional speed $N_i$ of the engine, and at the same time the air flow quantity $Q_{ai}$ is calculated on the basis of the output signals from the water temperature sensor 52 and the air flow meter 36, the thus obtained data being stored in the RAM 58.

Next, in a step 104, the basic pulse width $T_{pi}$ is calculated on the basis of the revolutional speed $N_i$ and the air flow quantity $Q_{ai}$ obtained in the step 102 on the basis of the expression (4) and the thus obtained data is stored in the RAM 58.

In a step 106, the revolution speed $N_i$ obtained in the step 102 and the basic pulse width $T_{pi}$ obtained in the step 104 are read out of the RAM 58, and a correction factor $K_{AFii}$ (%) is retrieved from the map of FIG. 5 on the basis of those read-out data, the retrieved correction factor being stored in the RAM 58.

Next, the operation is shifted to a step 108 in which the revolutional speed $N_i$ and the basic pulse width $T_{pi}$ are read out of the RAM 58. First, a basic pulse width for which the power correction is initiated, that is, a power correction initiation threshold $T_{PNi}$, at the revolutional speed $N_i$, is retrieved from the map of FIG. 6. That is, in FIG. 6, a solid line shows a boundary line of the basic pulse width for which the power correction is initiated, so that if the basic pulse width $T_{pi}$ takes a value within a region above the solid line in the drawing, the power correction is effected. A dotted line, on the contrary, shows a boundary line of the basic pulse width for which the power correction is terminated, that is, the power correction termination threshold $T_{PNi}'$, so that if the power correction is initiated once, it is continued unless the basic pulse width $T_{pi}$ comes into a region under the boundary line shown by the dotted line in the drawing.

Therefore, the power correction initiation threshold $T_{PNi}$ of the basic pulse width corresponding to the revolutional speed $N_i$ is retrieved from the map of FIG. 6. Then, judgement is made as to whether the basic pulse width $T_{pi}$ calculated in the step 104 is larger than the retrieved value $T_{PNi}$ or not, that is, whether the basic pulse width $T_{pi}$ takes a value within the power correction region or not.

If the judgement proves that $T_{pi} > T_{PNi}'$ the operation is shifted to a step 112 in which "1" is set in a flag 1 in a predetermined area in the RAM 58. If "1" is set in this flag 1, the power correction is performed, and on the contrary, if "0" is set, the power correction is not performed.

Next, the operation is shifted to a step 118 in which judgement is made as to whether "1" is set in the flag 1 or not. In this case "1" has been set, and therefore the operation is shifted to a step 120 in which the power correction factor $K_{pi}$ (%) is retrieved from the map of FIG. 7 on the basis of the revolutional speed $N_i$.

In a step 124, the pulse width $T_i$ of the valve opening pulse (that is, the fuel injection period of time) is calculated through the expression (3) on the basis of the correction factor $K_{AFii}$ obtained in the step 106 and the correction factor $K_{pi}$ obtained in the step 120, and the calculated data are set in the fuel injection time generating circuit of the I/O circuit 60, whereby a valve opening pulse having the obtained pulse width, that is, the time width $T_i$, is supplied to the fuel injection valve 40 through the output circuit so that the fuel having been subject to the power correction is injected to the engine.

Under the condition that the power correction is performed with the revolutional speed $N_i$ kept constant as described above, if the judgement proves in a step 110 that $T_{pi} \leqq T_{PNi}$, that is, if the basic pulse width $T_{pi}$ takes a value within a region under the solid line in FIG. 6, the operation is shifted to a step 114.

In the step 114, the power correction termination threshold $T_{PNi}'$ is retrieved from the map of FIG. 6 on the basis of the revolutional speed $N_i$ obtained in the step 102, and compared with the basic pulse width $T_{pi}$ obtained in the step 104.

Here, if $T_{pi} > T_{PNi}'$, that is, if the basic pulse width $T_{pi}$ takes a value within a region between the solid line and the dotted line of FIG. 6 ($T_{PNi} \leqq T_{pi} > T_{PNi}'$), the power correction is to be continued. The operation is therefore shifted into the step 118 in which if it is confirmed thaat "1" is set in the flag 1, the operation is shifted into the step 120, in which the power correction factor $K_{pi}$ is retrieved from the map of FIG. 7 on the basis of the revolutional speed $N_i$ obtained in the step 102.

Next, the operation is shifted into a step 125, and the basic pulse width $T_i$ is calculated to be produced.

Consequently, when the basic pulse width $T_{pi}$ comes in the power correction region, the power correction is continued as long as the basic pulse width $T_{pi}$ takes a value within a region above the dotted line in FIG. 6.

Under the condition as described above, if judgement proves that the basic pulse width $T_{pi}$ obtained in the step 104 takes a value within a region under the dotted line of FIG. 6, that is, if judgement proves in the step 114 that $T_{pi} \leqq T_{PNi}'$, the operation is shifted to a step 116, and the flag 1 is reset to "0".

Next, in the step 118, judgement is made as to whether "1" is set in the flag 1 or not. In this case, "0" has been set in the flag, and therefore judgement proves that the power correction is not to be performed, so that the operation is shifted to a step 122. In the step 122, the correction factor $K_i$ is selected to be zero, and the operation is shifted to the step 124 in which the basic pulse width $T_i$ is calculated on the basis of the expression (3) and produced as an output.

Consequently, when the power correction is performed once, the power correction is continued unless the basic pulse width $T_{pi}$ falls under correction termination threshold $T_{PNi}'$ slightly lower than the power correction initiation threshold $T_{PNi}$ in the drawing.

Further, at the revolutional speed $N_i$, if the power correction is not performed and if the opening degree of the throttle valve 38 is small so that the basic pulse width $T_{pi}$ is smaller than that the power correction initiation threshold $T_{PNi}$, the operation is shifted to the step 122 through the steps 102, 104, 106, 108, 110, 114, 116 and 118. In the step 122, the basic pulse width $T_i$ is calculated with the correction factor $K_{pi}$ set to be zero.

Figure 8:
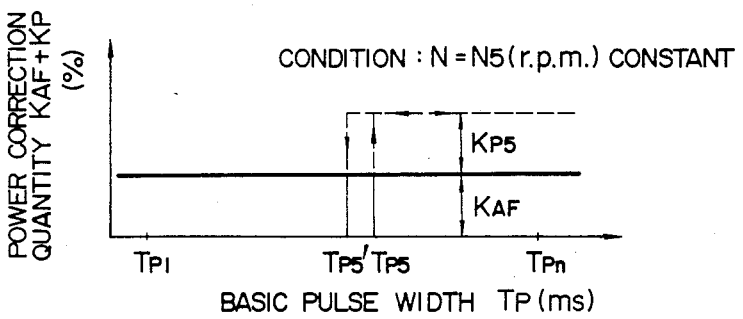
FIG. 8 is a diagram for explaining an example of the method of calculating the quantity of correction according to the present invention.

Referring to FIG. 8, the method of calculating the quantity of correction $(K_{Af}+K_p)$ % as described above will be described.

First, if the load is made higher with the revolutional speed N of the engine is kept constant, for example, $N_5$ (r.p.m.), the basic pulse width $T_{pi}$ becomes larger. When the basic pulse width $T_{pi}$ reaches a power correction initiation threshold $T_{PN5}$ at the revolutional speed $N_5$, as determined in FIG. 6, the judgement proves that the basic pulse width $T_{pi}$ comes in the power correction region. Then, the power correction factor $K_{p5}$ (%) corresponding to the revolutional speed $N_5$ is obtained from the map of FIG. 7 and added to the correction factor $K_{AF55}$ (%) obtained from the map of FIG. 5 on the basis of the revolutional speed $N_5$ and the basic pulse width $T_{p5}$ at this time to thereby obtain the quantity of correction (%).

In the case where the basic pulse width $T_{pi}$ is lower than the power correction initiation threshold $T_{PN5}$, on the other hand, only the correction factor $K_{AF5i}$ determined from the map of FIG. 5 on the basis of the revolutional speed $N_5$ and the basic pulse width $T_{pi}$ is obtained as the quantity of correction.

Thus, at the revolutional speed $N_5$, the power correction is continued so long as the basic pulse width $T_{pi}$ i larger than $T_{p5}$.

In this condition, even if the opening degree of the throttle valve 38 is made smaller with the revolutional speed kept at $N_5$, the power correction is not terminated unless the basic pulse width $T_{pi}$ becomes smaller than the power correction termination threshold $T_{PN5}'$. Thus, it is possible to prevent the injection time $T_i$ from fluctuating due to the fact that the power correction factor $K_{p5}$ is added in some cases while not added in other cases to the correction factor $K_{AF}$ in the state where the basic pulse width $T_{pi}$ fluctuates in the vicinity of the power correction initiation threshold $T_{PN5}$. Further, when the basic pulse width $T_{pi}$ becomes smaller than the power correction termination threshold $T_{PN5}'$ once, the power correction is not performed even if the basic pulse width $T_{pi}$ fluctuates in the vicinity of the power correction termination threshold $T_{PN5}'$. Consequently, the injection time $T_i$ is prevented from unstably fluctuating in a boundary portion of the power correction region.

The ratio of the power correction termination threshold $T_{PNi}'$ to the power correction initiation threshold $T_{PNi}$ is selected to be about 0.8:1.

Although it is defined that the power correction initiation threshold $T_{PNi}$ and the termination threshold $T_{PNi}'$ are variables with respect to the revolutional speed $N_i$ as shown in the map of FIG. 6 in this embodiment, these values may be, alternatively, constant independent of the revolutional speed $N_i$.

As described above, according to the present invention, the correction factor $K_{AF}$ of the air-fuel ratio is selected to be substantially constant relative to the basic pulse width $T_p$ as a factor for compensating only the characteristics of the injection valve, and in performing the power correction, the power correction factor $K_p$ is obtained separately from the correction factor $K_{AF}$ so that a sum of the correction factor $K_{AF}$ and the power correction factor $K_p$ is used as the quantity of correction for the basic pulse width $T_p$.

Figure 10:
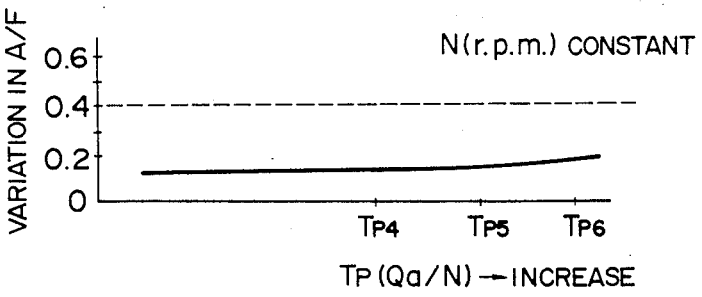
FIG. 10 is a diagram showing the variation in air-fuel ratio in the power correction means according to the present invention.

Therefore, as the opening degree of the throttle valve becomes larger, the transmission of the pulsation in suction air to the air flow meter becomes easier, so that even if the measured quantity $Q_a$ of air flow fluctuates, the variations in correction factor $(K_{AF}+K_p)$ is small, and therefore the variation in air-fuel ratio can be suppressed always so as not to excess the desired value of 0.4 as shown in FIG. 10.

I claim:

1. A fuel injection apparatus in an internal combustion engine, comprising:

fuel injection valve means for supplying said engine with fuel;

air flow rate detection means for detecting a quantity of air sucked by said engine;

engine revolutional speed detection means for detecting a revolutional speed of said engine;

load state determining means for determining whether said engine is in a highly loaded state or not;

control means for calculating a basic pulse width of a value opening pulse for said injection valve means on the basis of respective output signals of said air flow detection means and said engine speed detection means;

a first correction factor map storing a first set of predetermined correction factors corresponding to various values of the revolutional speed of said engine and various values of the valve opening pulse width for said injection valve means to be calculated by said control means;

a second correction factor map storing a second set of correction factors corresponding to various values of the revolutional speed of said engine; and said control means being arranged such that when said load state determining means determines there is no highly loaded state said control means reads out a correct factor corresponding to the revolutional speed of said engine detected at that time by said revolution speed detection means and the basic valve opening pulse width calculated at that time by said calculation means to thereby correct the basic valve opening pulse width calculated at that time with the read-out correction factor, while when said load state determining means determines there is a highly loaded state said control means reads out a correct factor corresponding to the revolutional speed of said engine detected at that time by said revolutional speed detection means and the basic value opening pulse width calculated at that time by said calculation means and further reads out another correction factor to thereby correct the basic value opening pulse width calculated at that time with a sum of said two read-out correction factors, said control means supplying said injection valve means with a valve opening pulse having the thus correct pulse width.

2. A fuel injection apparatus in an internal combustion engine according to claim 1, in which said load state determining means determines whether said engine is in a highly loaded state or not on the basis of the revolutional speed of said engine detected by said engine revolutional speed detection means and the basic valve opening pulse width calculated by said control means.

3. A fuel injection apparatus in an internal combustion engine according to claim 2, in which said load state determining means has a threshold map in which various threshold values of the basic valve opening pulse for determining the load state corresponding to the revolutional speed of said engine are predetermined in advance, so as to determine said engine to be in a highly loaded state when said calculated basic pulse width has a value larger than a threshold value in said threshold map corresponding to the revolutional speed of said engine detected by said engine revolutional speed detection means.

4. A fuel injection apparatus in an internal combustion engine according to claim 3, in which said threshold value varies depending on the revolutional speed of said engine.

5. A fuel injection apparatus in an internal combustion engine according to claim 3, in which having determined once that said engine is in a highly loaded state, said load state determining means determines that said engine is in said highly loaded state unless the basic valve opening pulse width is reduced to a value lower than one of said threshold values corresponding to the revolutional speed of said engine by a predetermined ratio.

* * * * *